US010144438B2

(12) United States Patent
Yanobu et al.

(10) Patent No.: US 10,144,438 B2
(45) Date of Patent: Dec. 4, 2018

(54) TRAVELING BOGIE AND TRACK-TYPE VEHICLE

(71) Applicant: MITSUBISHI HEAVY INDUSTRIES ENGINEERING, LTD., Yokohama-Shi, Kanagawa (JP)

(72) Inventors: Yukihide Yanobu, Tokyo (JP); Hiroyuki Kono, Tokyo (JP); Akihisa Kawauchi, Tokyo (JP); Kousuke Katahira, Tokyo (JP); So Tamura, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 163 days.

(21) Appl. No.: 15/032,302

(22) PCT Filed: Oct. 22, 2014

(86) PCT No.: PCT/JP2014/078088
§ 371 (c)(1),
(2) Date: Apr. 26, 2016

(87) PCT Pub. No.: WO2015/079833
PCT Pub. Date: Jun. 4, 2015

(65) Prior Publication Data

US 2016/0264156 A1 Sep. 15, 2016

(30) Foreign Application Priority Data

Nov. 28, 2013 (JP) ..... 2013-245814

(51) Int. Cl.
*B61F 5/38* (2006.01)
*B61B 13/04* (2006.01)
(Continued)

(52) U.S. Cl.
CPC ..... *B61F 5/38* (2013.01); *B61B 13/04* (2013.01); *B61F 3/16* (2013.01); *B61F 5/148* (2013.01); *B61F 5/386* (2013.01); *B61F 9/00* (2013.01)

(58) Field of Classification Search
CPC .... B61F 13/00; B61F 5/38; B61F 5/44; B61F 5/46; B61F 5/50; B61F 5/52
See application file for complete search history.

(56) References Cited

U.S. PATENT DOCUMENTS 6,477,963 B1 11/2002 Weule et al.
8,074,577 B2 * 12/2011 Morichika ..... B61B 10/001 104/130.09

FOREIGN PATENT DOCUMENTS

JP 49-42610 U 4/1974
JP 52-14885 B2 4/1977
(Continued)

OTHER PUBLICATIONS

International Search Report in PCT Application No. PCT/JP2014/078088, dated Jan. 27, 2015.
(Continued)

*Primary Examiner* — Robert J McCarry, Jr.
(74) *Attorney, Agent, or Firm* — Kanesaka Berner and Partners, LLP

(57) ABSTRACT

A traveling bogie includes a steerable wheel, a bogie main body configured to support the steerable wheel, a guide apparatus pivotally supported by the bogie main body and turned by receiving a reaction force from a guide rail, a steering mechanism configured to apply a steering force to the steerable wheel using the reaction force received by the guide apparatus, and an assist mechanism configured to
(Continued)

apply an auxiliary steering force for assisting with the steering force from the steering mechanism to the steerable wheel.

8 Claims, 7 Drawing Sheets

(51) Int. Cl.

| | |
|---|---|
| ***B61F 3/16*** | (2006.01) |
| ***B61F 5/14*** | (2006.01) |
| ***B61F 9/00*** | (2006.01) |

(56) References Cited

FOREIGN PATENT DOCUMENTS

| | | | |
|---|---|---|---|
| JP | 53-140715 | A | 12/1978 |
| JP | 57-24600 | Y2 | 5/1982 |
| JP | 1-41547 | B2 | 9/1989 |
| JP | 2007-216815 | A | 8/2007 |
| JP | 2010-195310 | A | 9/2010 |
| JP | 2010-215120 | A | 9/2010 |
| WO | 2013/094336 | A1 | 6/2013 |

OTHER PUBLICATIONS

Written Opinion of the ISA in PCT Application No. PCT/JP2014/078088, dated Jan. 27, 2015.

* cited by examiner

TRAVELING BOGIE AND TRACK-TYPE VEHICLE

RELATED APPLICATIONS

The present application is a National Phase of PCT/JP2014/078088, filed Oct. 22, 2014, and claims priority based on Japanese Patent Application No. 2013-245814, filed Nov. 28, 2013.

TECHNICAL FIELD

The present invention relates to a traveling bogie and a track-type vehicle.

BACKGROUND ART

As a new transportation system other than a bus or a railroad, a track-type traffic system configured to travel on a track by running wheels constituted by rubber tires is known. Such a track-type traffic system is generally referred to as "a new transportation system" or "an automated people mover (APM)," or the like. In the track-type traffic system, guide wheels disposed at both side sections or the like of a vehicle are guided by guide rails provided along the track.

In the vehicle of the above-mentioned track-type traffic system, the running wheels or guide wheels are installed on a traveling bogie disposed under the vehicle. The traveling bogie includes a mechanism configured to steer the running wheels (steerable wheels) using a force (reaction force) of pressing the guide wheels to the guide rails when the vehicle passes through a curved section (for example, see Patent Literature 1). In Patent Literature 1, the traveling bogie includes a guide apparatus having the guide wheels and turnably attached to the vehicle, and a steering mechanism (a tie rod, a tie rod arm) configured to steer the steerable wheels according to turning movement of the guide apparatus.

CITATION LIST

Patent Literature

[Patent Literature 1] Japanese Unexamined Patent Application, First Publication No. 2010-195310

SUMMARY OF INVENTION

Technical Problem

In recent years, an increase in the load that a vehicle can withstand, higher speeds in track-type traffic systems, and the like are required, and thus use of wide running wheels is considered.

However, when a width dimension of the steerable wheels is increased, since a frictional force between the steerable wheels and the track, a kingpin offset amount, a self-aligning torque, and so on, are increased, a force required for steering of the steerable wheels is increased. That is, when the steerable wheels are steered, a reaction force received from the guide rail by the guide apparatus is increased.

Meanwhile, since strength or durability of the guide apparatus or the guide rail is restricted, a magnitude of the reaction force received from the guide rails by the guide apparatus when the steerable wheels are steered is also restricted.

The present invention provides a traveling bogie and a track-type vehicle that are capable of steering wide steerable wheels while limiting a reaction force received by a guide apparatus to a small value.

Solution to Problem

According to a first aspect of the present invention, there is provided a traveling bogie that is guided by a guide rail installed along a track to travel, the traveling bogie including a steerable wheel; a bogie main body configured to support the steerable wheel; a guide apparatus that is pivotally supported by the bogie main body and turned by receiving a reaction force from the guide rail; a steering mechanism configured to apply a steering force to the steerable wheel using the reaction force received by the guide apparatus; and an assist mechanism configured to apply an auxiliary steering force for assisting with the steering force from the steering mechanism to the steerable wheel.

When the traveling bogie having the above-mentioned configuration travels along the curved section of the track, as the guide apparatus is pushed against the guide rail, the guide apparatus receives the reaction force from the guide rail to be turned. In addition, as the steering force is applied to the steerable wheel using the above-mentioned reaction force by the steering mechanism, the steerable wheel can be steered and the steerable wheel can be oriented in an advance direction of the traveling bogie along the curved section of the track.

Then, in the traveling bogie having the above-mentioned configuration, when the steerable wheel is steered by the steering mechanism, since the auxiliary steering force is also applied to the steerable wheel by the assist mechanism, the steerable wheel can be steered while limiting the reaction force received from the guide rail by the guide apparatus to a small value.

According to a second aspect of the present invention, in the traveling bogie, the assist mechanism may include an actuator configured to generate the auxiliary steering force; a detection unit configured to detect a state of the guide apparatus; and a control unit configured to control an operation of the actuator according to a detection result of the detection unit.

In the traveling bogie, the state of the guide apparatus detected by the detection unit is, for example, a turning angle of the guide apparatus with respect to the bogie main body or a reaction force received from the guide rail by the guide apparatus.

According to the traveling bogie having the above-mentioned configuration, since the control unit controls an operation of the actuator based on the state of the guide apparatus detected by the detection unit, the auxiliary steering force can be precisely applied to the steerable wheel. Accordingly, the steering angle of the steerable wheel steered by the steering mechanism can be prevented from varying due to application of the auxiliary steering force.

According to a third aspect of the present invention, in the traveling bogie, the actuator may be attached to the bogie main body.

According to the traveling bogie having the above-mentioned configuration, when the auxiliary steering force generated by the actuator is transmitted to the steerable wheel, since the reaction force of the auxiliary steering force can be received by the bogie main body, the auxiliary steering force can be efficiently applied to the steerable wheel.

According to a fourth aspect of the present invention, in the traveling bogie, a pair of steerable wheels may be provided separated by an interval in the vehicle width direction, and a pair of actuators may be individually provided with respect to the pair of steerable wheels.

According to the traveling bogie having the above-mentioned configuration, in comparison with the case in which an auxiliary operating force of the single actuator is applied to the pair of steerable wheels, a magnitude of the auxiliary steering force generated by each of the actuators can be reduced. That is, the actuators having a small output can be provided. Accordingly, the assist mechanism can be constituted by inexpensive actuators, and the manufacturing cost of the traveling bogie can be reduced.

According to a fifth aspect of the present invention, a track-type vehicle includes the traveling bogie; and a vehicle body supported by the traveling bogie.

Advantageous Effects of Invention

According to the above-mentioned traveling bogie, the wide steerable wheels can be steered while limiting the reaction force received from the guide rails by the guide apparatus to a small value.

DESCRIPTION OF EMBODIMENTS

First Embodiment

Hereinafter, a first embodiment of the present invention will be described with reference to FIGS. 1 to 6.

Figure 1:
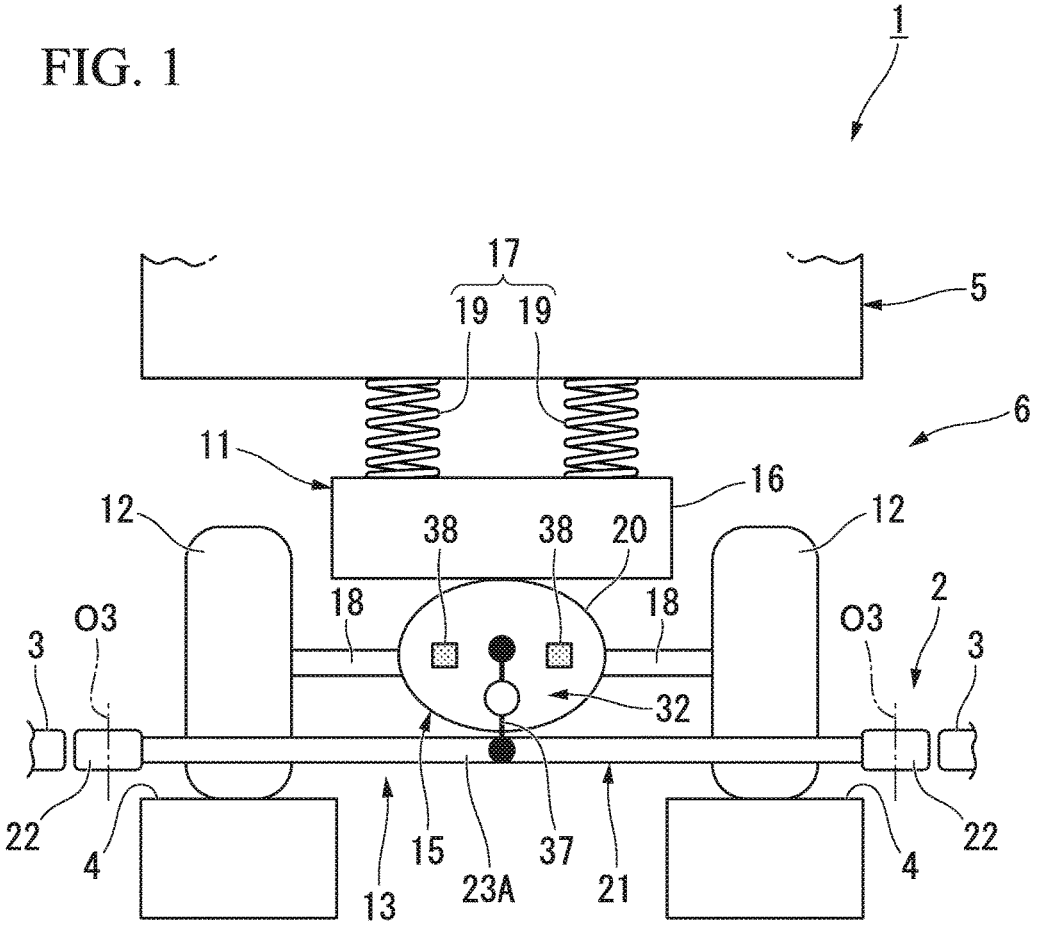
FIG. 1 is a front view showing a track-type vehicle according to a first embodiment of the present invention.
Figure 2:
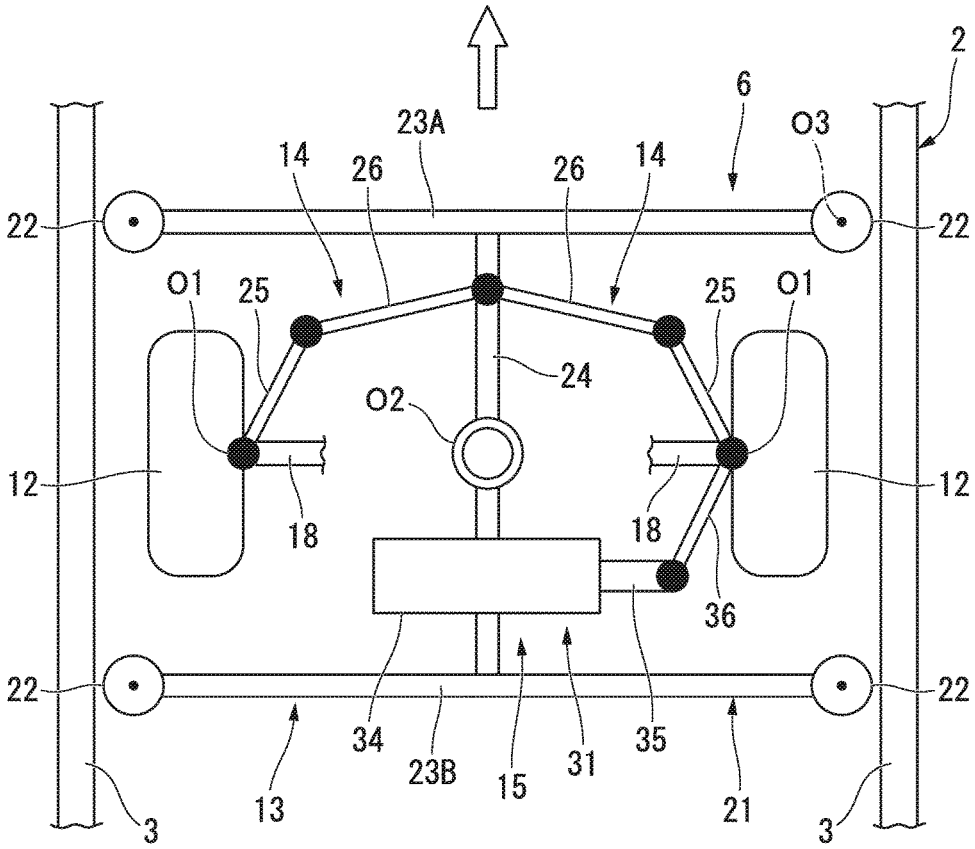
FIG. 2 is a plan view showing the track-type vehicle of FIG. 1.

As shown in FIGS. 1 and 2, a track-type vehicle 1 (hereinafter, simply referred to as the vehicle 1) according to the embodiment is guided by so-called side guide type guide rails 3 installed at both side sections in a widthwise direction of a track 2 to travel on a traveling path 4 of the track 2.

The vehicle 1 includes a vehicle body 5 and traveling dollies 6. The vehicle body 5 has a substantially hollow rectangular parallelepiped shape elongated forward and backward in a traveling direction. A space configured to accommodate passengers is formed in the vehicle body 5.

The traveling dollies 6 support the vehicle body 5 from below, and travel on the track 2. The traveling dollies 6 are disposed under a front section and a rear section of the vehicle body 5. Since the traveling dollies 6 differ from each other only in whether the traveling bogie is disposed at the front section or the rear section of the vehicle body 5, in the following description, only the traveling bogie 6 disposed at the front section will be described.

The traveling bogie 6 includes a bogie main body 11, steerable wheels 12, a guide apparatus 13 and steering mechanisms 14. The bogie main body 11 supports the vehicle body 5 from below. The bogie main body 11 includes a bogie frame 16, a shock absorber 17 and an axle 18.

The shock absorber 17 is installed between the vehicle body 5 and the bogie frame 16. The shock absorber 17 prevents vibrations caused by unevenness on a road surface of the traveling path 4 from being transmitted to the vehicle body 5. The shock absorber 17 includes, for example, spring members 19. Two spring members 19 are disposed separated by an interval, for example, in the vehicle width direction of the vehicle body 5. The spring members 19 may be, for example, air springs.

The axle 18 is supported by the bogie frame 16. The axle 18 extends from a gear box 20 disposed at a central section in the vehicle width direction toward both sides in the vehicle width direction. A mechanism such as a differential gear or the like configured to transmit a rotational power from a power source (not shown) such as a motor or the like to the axle 18 is accommodated in the gear box 20. In the example shown, as the gear box 20 is fixed to a lower side of the bogie frame 16, the axle 18 is supported by the bogie frame 16 via the gear box 20, but is not limited thereto.

The steerable wheels 12 are so-called tire-attached wheels on which rubber tires are mounted. The steerable wheels 12 are joined with both ends of each of the axles 18 extending to both sides in the vehicle width direction, and configured to be rotatable about the axle 18 together with the axle 18. Accordingly, the vehicle 1 can travel on the traveling path 4 of the track 2. In addition, the steerable wheels 12 are configured to be rotatable about steering shafts O1 (for example, kingpins) disposed at end portions of both sides in the vehicle width direction of the axle 18 with respect to the bogie main body 11. As the steerable wheels 12 are pivoted around the steering shaft O1, the direction in which the vehicle 1 advances can be varied.

The guide apparatus 13 is disposed under the bogie main body 11 and turnably supported around a turning axis O2 extending in a vertical direction with respect to the bogie main body 11. The guide apparatus 13 receives a reaction force from the guide rail 3 to be turned. The guide apparatus 13 includes a guide frame 21 and a guide wheel 22.

The guide frame 21 includes horizontal beams 23A and 23B, and a vertical beam 24. The horizontal beams 23A and 23B are formed to extend closer to both outer sides in the vehicle width direction than the steerable wheels 12. In addition, the horizontal beams 23A and 23B are disposed at a front side and a rear side in a traveling direction of the steerable wheels 12. The vertical beam 24 extends in the traveling direction of the steerable wheels 12, and joins the pair of front and rear horizontal beams 23A and 23B at an intermediate portion in the vehicle width direction. The vertical beam 24 is turnably attached around the turning axis O2 with respect to the bogie main body 11 at the intermediate portion in an extending direction thereof.

The guide wheels 22 are guided by the guide rails 3 disposed at both sides in the vehicle width direction of the track 2. The guide wheels 22 are attached to both end portions of the horizontal beams 23A and 23B, and configured to be rotatable about axes O3 extending in the vertical direction. The guide wheels 22 roll along the guide rails 3 by abutting the guide rail 3 when the vehicle 1 travels on the track 2.

In the guide apparatus 13, the width dimension of the guide apparatus 13 in the extending direction of the horizontal beams 23A and 23B is set to be smaller than the distance between the guide rails 3. In addition, in the guide apparatus 13, as portions of the guide wheels 22 are pressed against the guide rails 3, the guide wheels 22 receive a reaction force from the guide rails 3 to be turned (see FIG. 5).

The steering mechanisms 14 apply a steering force to the steerable wheels 12 using the reaction force received by the above-mentioned guide apparatus 13. The steering mechanisms 14 connect the guide apparatus 13 and the steering shafts O1 of the steerable wheels 12 to each other and pivot the steerable wheels 12 in the same direction as the turning direction of the guide apparatus 13 around the steering shaft O1 when the guide apparatus 13 is turned. The steering mechanisms 14 are installed at each of the steerable wheels 12. Each of the steering mechanisms 14 includes a first connecting arm 25 and a second connecting arm 26.

A first end in a longitudinal direction of the first connecting arm 25 is attached pivotally about the steering shaft O1 (in a steering direction of the steerable wheels 12) together with the steerable wheels 12.

The second connecting arm 26 connects the first connecting arm 25 and the vertical beam 24 of the guide frame 21.

A first end in the longitudinal direction of the second connecting arm 26 is rotatably connected to a second end of the first connecting arm 25. A second end of the second connecting arm 26 is rotatably connected to the vertical beam 24 of the guide frame 21. A connecting portion of the vertical beam 24 to the second connecting arm 26 is disposed between the turning axis O2 and an end portion of the vertical beam 24 (a joining portion between the horizontal beams 23A and 23B). In the example shown, while the connecting portion of the first and second connecting arms 25 and 26 is disposed closer to a front side in the traveling direction of the vehicle 1 (the traveling bogie 6) than the steering shaft O1 and the connecting portion of the vertical beam 24 to the second connecting arm 26 is disposed closer to the front side in the traveling direction of the vehicle 1 (the traveling bogie 6) than the turning axis O2, the embodiment is not limited thereto. For example, the connecting portion of the first and second connecting arms 25 and 26 may be disposed closer to a rear side in the traveling direction of the vehicle 1 (the traveling bogie 6) than the steering shaft O1 and the connecting portion of the vertical beam 24 to the second connecting arm 26 may be disposed closer to the rear side in the traveling direction of the vehicle 1 (the traveling bogie 6) than the turning axis O2.

Figure 5:
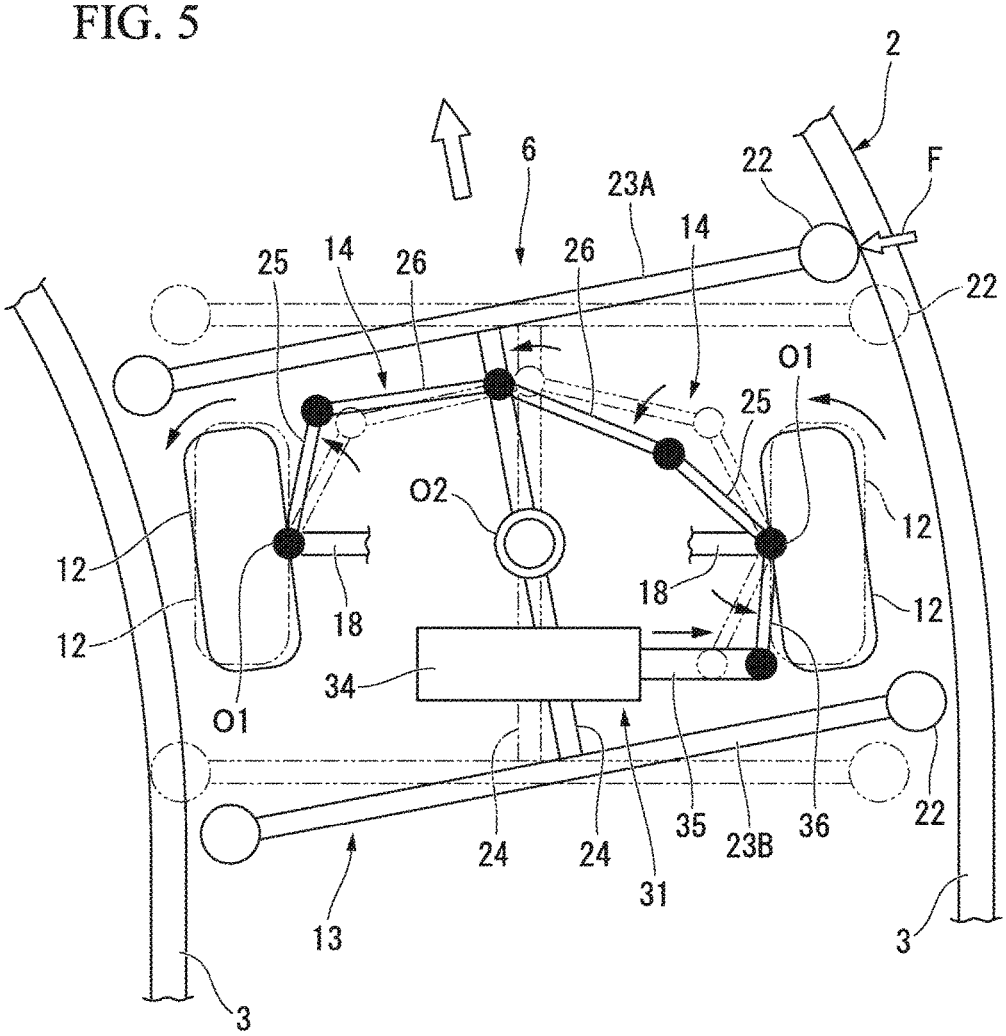
FIG. 5 is a plan view showing the state in which the track-type vehicle of FIGS. 1 and 2 travels along the curved section of the track.

In the steering mechanism 14 having the above-mentioned configuration, when the guide apparatus 13 receives a reaction force from the guide rails 3 to be turned around the turning axis O2, as the second connecting arm 26 is displaced and the first connecting arm 25 is pivoted around the steering shaft O1, the steerable wheels 12 are steered in the same direction as the turning direction of the guide apparatus 13 (see FIG. 5). That is, as the steering mechanisms 14 apply a steering force to the steerable wheels 12 using a reaction force received by the guide apparatus 13, the steerable wheels 12 are steered in the same direction as the turning direction of the guide apparatus 13.

Figure 3:
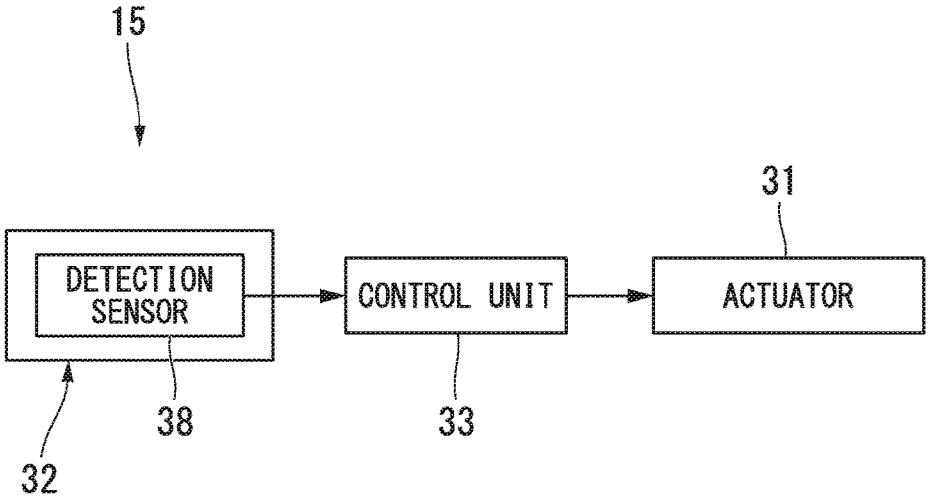
FIG. 3 is a block diagram showing an assist mechanism included in the track-type vehicle of FIGS. 1 and 2.

Further, as shown in FIGS. 1 to 3, the traveling bogie 6 includes an assist mechanism 15 configured to apply an auxiliary steering force configured to assist with a steering force from the above-mentioned steering mechanism 14 to the steerable wheels 12. The assist mechanism 15 includes an actuator 31, a detection unit 32 and a control unit 33.

The actuator 31 generates an auxiliary steering force. The actuator 31 of the embodiment is, for example, an air cylinder, a hydraulic cylinder or an electric cylinder, and includes a cylinder main body 34 and a piston rod 35. The cylinder main body 34 is attached to the bogie main body 11. The piston rod 35 is attached to the cylinder main body 34 to be extended and contracted. The extension and contraction direction of the piston rod 35 is set to the vehicle width direction. A first end of an assist arm 36 is rotatably connected to a front end of the piston rod 35 of the actuator 31. A second end of the assist arm 36 is pivotally attached around the steering shaft O1 together with the steerable wheels 12.

In the actuator 31, the piston rod 35 is extended and contracted with respect to the cylinder main body 34. The force of the piston rod 35 extending and contracting is transmitted to the steerable wheels 12 via the assist arm 36 and applied to the steerable wheels 12 as an auxiliary steering force. The force (the auxiliary steering force) of the piston rod 35 extending and contracting or displacement of the piston rod 35 is controlled based on a control signal from the control unit 33 (to be described below).

The actuator 31 of the embodiment is connected to only one of the steerable wheels 12 via the assist arm 36. The auxiliary steering force of the actuator 31 is applied to the other steerable wheel 12 via the steering mechanism 14 connected to the one of the steerable wheels 12, the guide frame 21 (the vertical beam 24), and the steering mechanism 14 connected to the other steerable wheel 12.

The detection unit 32 detects a state of the guide apparatus 13. The detection unit 32 of the embodiment detects a turning angle of the guide apparatus 13 as the state of the guide apparatus 13. Here, a turning direction of the guide apparatus 13 corresponds to a steering direction of the steerable wheels 12 connected to the guide apparatus 13 by the steering mechanism 14.

Accordingly, the detection unit 32 can detect the steering angle of the steerable wheels 12 by detecting the turning angle of the guide apparatus 13. The turning angle of the guide apparatus 13 and the steering angle of the steerable wheels 12 detected by the detection unit 32 are angles detected with reference to an orientation of the steerable wheels 12 (in addition, a turning position of the guide apparatus 13 corresponding thereto).

The detection unit 32 of the embodiment includes a detection link 37 and detection sensors 38.

The detection link 37 is rotatably attached to the bogie main body 11. A first end of the detection link 37 is connected to the horizontal beam 23A of the guide apparatus 13. Accordingly, the detection link 37 rotates to correspond to the turning of the guide apparatus 13. A second end of the detection link 37 is disposed to approach or separate from the detection sensors 38 fixed to the bogie main body 11 according to rotation of the detection link 37. In the example shown, while the detection sensors 38 are disposed at both sides in the moving direction of the second end of the detection link 37, for example, the detection sensor 38 may be disposed at only one side.

The detection sensor 38 is configured to detect movement of the detection link 37, and may use an arbitrary type such as a load detection type, a contact type, a displacement detection type, a laser detection type, or the like. A detection result of the detection sensor 38 is output to the control unit 33 as a detection signal.

The control unit 33 controls an operation of the actuator 31 based on the detection result of the above-mentioned detection unit 32 (the detection sensor 38). Hereinafter, the control unit 33 of the embodiment will be described in detail.

The control unit 33 calculates a self-aligning torque of the steerable wheels 12 (a rotational force of returning the steerable wheels 12 to a straight running state) as a reaction force received by the guide apparatus 13 based on the turning angle of the guide apparatus 13 (the steering angle of the steerable wheels 12) detected by the detection unit 32. In the calculation, the width dimension or the material of the steerable wheels 12, the traveling speed, the load of a vehicle applied to the steerable wheels 12, or the like, can also be considered.

Then, the control unit 33 sets the auxiliary steering force applied to the steerable wheels 12 based on the calculated reaction force. The auxiliary steering force is smaller than the reaction force received by the guide apparatus 13, and set to, for example, 50% of the reaction force. After that, the control unit 33 outputs a control signal including a set auxiliary steering force to the actuator 31. Accordingly, the actuator 31 generates an auxiliary steering force.

In addition, the control unit 33 calculates displacement of the actuator 31 such that the steerable wheels 12 are not excessively steered by displacement of the piston rod 35 (displacement of the actuator 31) with respect to the cylinder main body 34 based on the turning angle of the guide apparatus 13 detected by the detection unit 32. For example, the displacement of the actuator 31 is calculated such that the assist arm 36 is pivoted to match the steering angle of the steerable wheels 12 and pivotal movement of the assist arm 36 is not inhibited by the piston rod 35. After that, the control unit 33 outputs the control signal including the calculated displacement of the actuator 31 to the actuator 31.

In addition, the control unit 33 does not output the control signal including the auxiliary steering force to the actuator 31 when the calculated reaction force is a predetermined value or less and the turning angle of the guide apparatus 13 or the steering angle of the steerable wheels 12 is a predetermined angle or less. That is, when the steering angle of the steerable wheels 12 is the predetermined angle or less, the actuator 31 does not generate the auxiliary steering force.

Next, an operation of the vehicle 1 of the embodiment having the above-mentioned configuration will be described.

Figure 4:
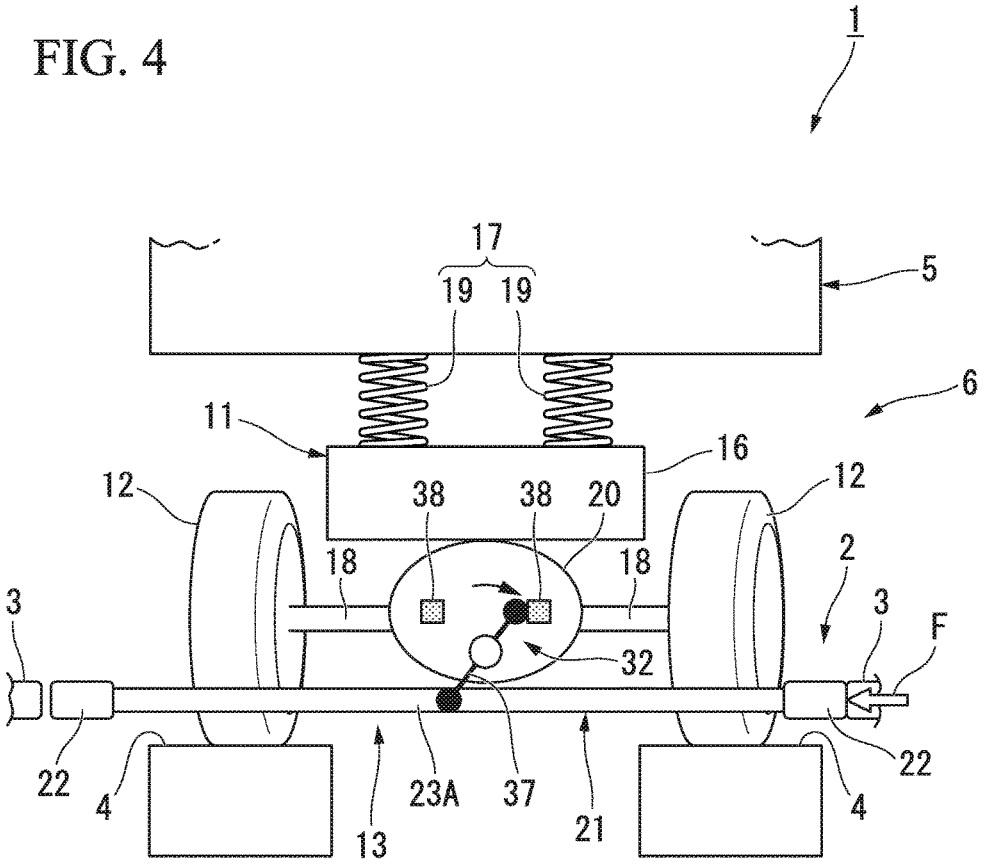
FIG. 4 is a front view showing a state in which the track-type vehicle of FIGS. 1 and 2 travels along a curved section of a track.

As shown in FIGS. 4 and 5, when the vehicle 1 travels along the curved section of the track 2, the guide wheels 22 of the guide apparatus 13 receive a reaction force F from the guide rail 3 disposed at the outside rail side of the curved section, mainly by the guide wheel 22 of the outside rail side of the front side from the outside in the vehicle width direction. Based on the reaction force F, the guide apparatus 13 turns around the turning axis O2 so that the front side (the horizontal beam 23A side) of the guide apparatus 13 approaches the guide rail 3 of the inner track side. In addition, according to the turning of the guide apparatus 13, the steering force using the above-mentioned reaction force F is applied to the steerable wheels 12 by the steering mechanisms 14, and the steerable wheels 12 are steered in the same direction as the turning direction of the guide apparatus 13 around the steering shaft O1. That is, the steerable wheels 12 can be oriented in the direction in which the vehicle 1 advances along the curved section of the track 2. Accordingly, the vehicle 1 travels along the curved section of the track 2.

In addition, when the steerable wheels 12 are steered at the curved section of the track 2, the auxiliary steering force from the assist mechanism 15 is also applied to the steerable wheel 12. Hereinafter, this will be specifically described.

Figure 6:
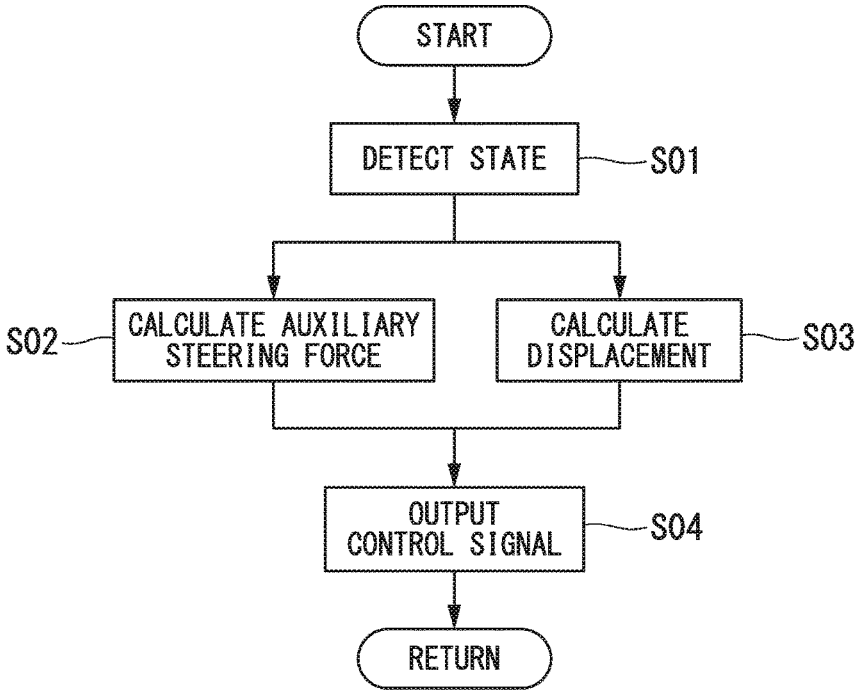
FIG. 6 is a flowchart showing control processing in a control unit of FIG. 3.

When the guide apparatus 13 receives the reaction force F from the guide rails 3 to be turned, the detection sensor 38 of the detection unit 32 detects movement of the detection link 37 connected to the guide apparatus 13. Here, as shown in FIG. 6, the control unit 33 receives a signal from the detection sensor 38 and detects a turning angle of the guide apparatus 13 (a state of the guide apparatus 13) (step S01). Next, the control unit 33 calculates the reaction force F received by the guide apparatus 13 based on the turning angle of the guide apparatus 13 and sets the auxiliary steering force applied to the steerable wheels 12 based on the calculated reaction force F (step S02). In addition, the control unit 33 calculates displacement of the actuator 31 based on the turning angle of the guide apparatus 13 (step S03). The displacement of the actuator 31 is calculated such that the steerable wheels 12 are not excessively steered by the displacement. After that, the control unit 33 outputs the control signal including the auxiliary steering force set in step S02 and step S03 and the displacement of the actuator 31 to the actuator 31 (step S04).

The processing of the above-mentioned steps S01 to S04 is repeatedly performed in a state in which the vehicle travels on the traveling path 4 of the track 2.

As shown in FIG. 5, the actuator 31 generates the auxiliary steering force based on the control signal output from the control unit 33. The auxiliary steering force is applied to the steerable wheels 12 via the assist arms 36. In addition, in the actuator 31, the displacement of the piston rod 35 with respect to the cylinder main body 34 is set by the control signal output from the control unit 33, and the steerable wheels 12 can be prevented from being steered by the operation of the actuator 31.

As described above, according to the traveling bogie 6 of the embodiment and the vehicle 1 including the same, when the steerable wheels 12 are steered by the steering mechanisms 14, the auxiliary steering force is applied to the steerable wheels 12 by the assist mechanisms 15. For this reason, even when the steerable wheels 12 are wide, the steerable wheels 12 can be steered while the reaction force in which the guide apparatus 13 receives from the guide rail 3 is limited to a small value. Accordingly, it is possible to provide the vehicle 1 capable of coping with an increase loads to be withstood and high speeds of the track-type traffic system.

In addition, according to the traveling bogie 6 and the vehicle 1 of the embodiment, since the control unit 33 controls the operation of the actuator 31 based on the turning angle of the guide apparatus 13 (the state of the guide apparatus 13) detected in the detection unit 32, the auxiliary steering force can be precisely applied to the steerable wheels 12. Accordingly, the steering angle of the steerable wheels 12 steered by the steering mechanism 14 can be prevented from varying due to application of the auxiliary steering force.

Further, since the cylinder main body 34 of the actuator 31 is attached to the bogie main body 11, when the auxiliary steering force generated by the actuator 31 is transmitted to the steerable wheels 12, the reaction force of auxiliary steering force can be received by the bogie main body 11. For this reason, the auxiliary steering force can be efficiently applied to the steerable wheels 12.

In addition, according to the embodiment, even though the guide apparatus 13 receives a minute reaction force from the guide rail 3 when the vehicle 1 travels along a straight section of the track 2, if the steering angle of the steerable wheels 12 according thereto is a predetermined angle or less, the auxiliary steering force is not applied to the steerable wheels 12. For this reason, even if the guide apparatus 13 receives the minute reaction force and the steerable wheels 12 are steered when the vehicle 1 travels along the straight section of the track 2, the steerable wheels 12 can be rapidly returned to the straight advance state by a self-aligning torque. Accordingly, the vehicle 1 can travel along the straight section of the track 2 in a stable state.

Second Embodiment

Next, a second embodiment of the present invention will be described with reference to FIG. 7, focusing on differences from the first embodiment. Further, common components with the first embodiment are designated by the same reference numerals and a description thereof will be omitted.

Figure 7:
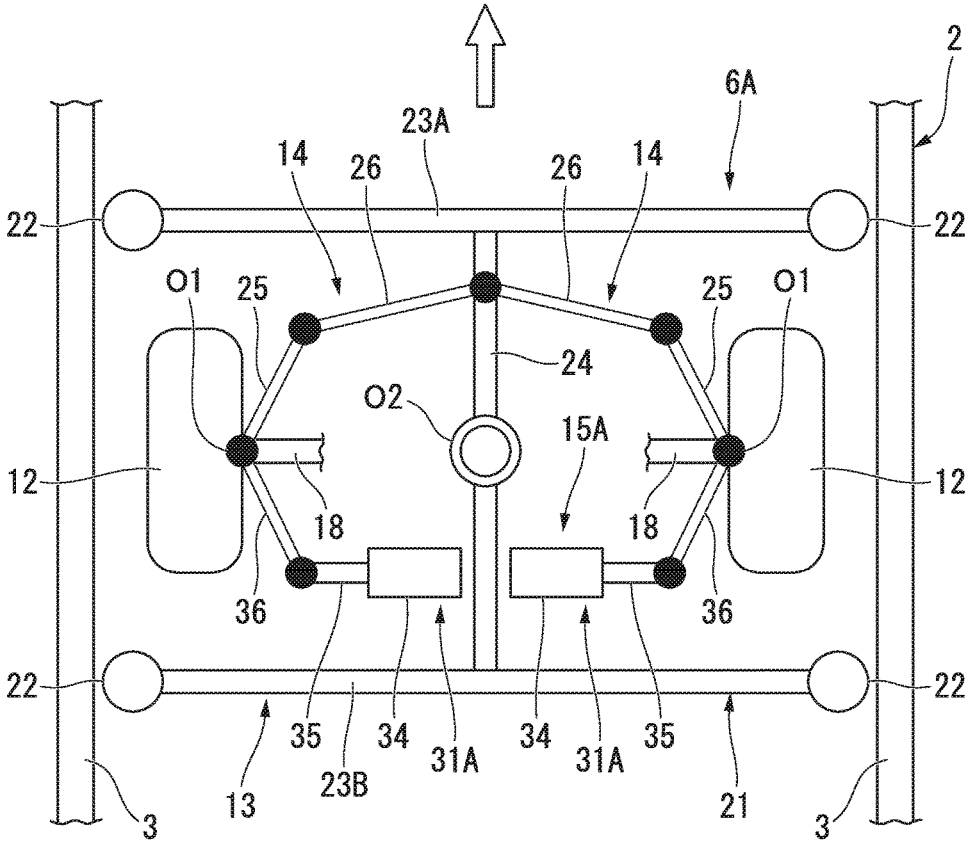
FIG. 7 is a plan view showing a track-type vehicle according to a second embodiment of the present invention.

As shown in FIG. 7, an assist mechanism 15A included in a traveling bogie 6A of the track-type vehicle (the vehicle) of the embodiment includes the same actuator 31A as the first embodiment. However, in the assist mechanism 15A of the embodiment, the actuator 31A is installed at each of the steerable wheels 12.

Each of the actuators 31A includes the same cylinder main body 34 and the same piston rod 35 as the first embodiment. In addition, the piston rods 35 of the actuators 31A are connected to the steerable wheels 12 via each of the assist arms 36 as in the first embodiment. Further, an operation of each of the actuators 31A is controlled based on a control signal from the same control unit 33 (see FIG. 3) as in the first embodiment.

The traveling bogie 6A and track-type vehicle of the embodiment exhibit the same effects as the first embodiment.

In addition, according to the traveling bogie 6A and track-type vehicle of the embodiment, in comparison with the configuration of the first embodiment in which the auxiliary steering force of the single actuator 31 is applied to the pair of steerable wheels 12, a magnitude of the auxiliary steering force generated in each of the actuators 31A can be reduced. That is, in comparison with the case of the first embodiment, the actuator 31A having a small output can be provided. Accordingly, the assist mechanism 15A can be constituted by the actuators 31A that are inexpensive, and the manufacturing cost of the traveling bogie 6A can be reduced.

While the present invention has been described above in detail, the present invention is not limited to the above-mentioned embodiments but various modifications may be made without departing from the scope of the present invention.

In the embodiment, while the detection units 32 of the assist mechanisms 15 and 15A detect the turning angle of the guide apparatus 13 as the state of the guide apparatus 13, for example, the reaction force received by the guide apparatus 13 may be detected. Specifically, a force of pressing the second end of the detection link 37 rotated according to the turning of the guide apparatus 13 against the detection sensor 38 may be detected as the reaction force. In this case, the control unit 33 may set the auxiliary steering force based on the reaction force serving as the detection result. In addition, the control unit 33 may calculate displacement of the actuator 31 based on the reaction force serving as the detection result.

In addition, the present invention is not limited to the traveling bogie 6 that is guided by the side guide type guide rails 3 provided at both end portions in the widthwise direction of the track 2 to travel as in the embodiment but, for example, may be applied to a traveling bogie that is guided by a center guide type guide rail installed at a central section in the widthwise direction of the track to travel.

INDUSTRIAL APPLICABILITY

According to the traveling bogie, the wide steerable wheels can be steered while limiting the reaction force received from the guide rails by the guide apparatus to a small value.

REFERENCE SIGNS LIST

1 track-type vehicle
2 track
3 guide rail
5 vehicle body
6, 6A traveling bogie
11 bogie main body
12 steerable wheel
13 guide apparatus
14 steering mechanism
15, 15A assist mechanism
31, 31A actuator
32 detection unit
33 control unit

The invention claimed is:

1. A traveling bogie that is guided by a guide rail installed along a track to travel, the traveling bogie comprising:
a steerable wheel;
a bogie main body configured to support the steerable wheel;
a guide apparatus that is pivotally supported by the bogie main body and turned by receiving a reaction force from the guide rail;
a steering mechanism configured to apply a steering force to the steerable wheel using the reaction force received by the guide apparatus; and
an assist mechanism configured to apply an auxiliary steering force for assisting with the steering force from the steering mechanism to the steerable wheel,
wherein the assist mechanism comprises:
an actuator configured to generate the auxiliary steering force;
a detection unit configured to detect a turning angle of the guide apparatus; and
a control unit configured to control an operation of the actuator based on the turning angle of the guide apparatus detected by the detection unit.

2. The traveling bogie according to claim 1, wherein the actuator is attached to the bogie main body.

3. The traveling bogie according to claim 2, wherein a pair of steerable wheels are provided separated by an interval in a vehicle width direction, and
a pair of actuators are individually provided with respect to the pair of steerable wheels.

4. A track-type vehicle comprising:
the traveling bogie according to claim 3; and
a vehicle body supported by the traveling bogie.

5. A track-type vehicle comprising:
the traveling bogie according to claim 2; and
a vehicle body supported by the traveling bogie.

6. The traveling bogie according to claim 1, wherein a pair of steerable wheels are provided separated by an interval in a vehicle width direction, and
a pair of actuators are individually provided with respect to the pair of steerable wheels.

7. A track-type vehicle comprising:
the traveling bogie according to claim 6; and
a vehicle body supported by the traveling bogie.

8. A track-type vehicle comprising:

the traveling bogie according to claim 1; and a vehicle body supported by the traveling bogie.

* * * * *